United States Patent [19]

Weiss

[11] Patent Number: 4,541,372

[45] Date of Patent: Sep. 17, 1985

[54] ENGINE WITH LOAD DEPENDENT VARIABLY OPERABLE INTAKE AND EXHAUST VALVING

[75] Inventor: Edwin Weiss, Gummersbach, Fed. Rep. of Germany

[73] Assignee: Ford Motor Company, Dearborn, Mich.

[21] Appl. No.: 565,323

[22] Filed: Dec. 27, 1983

[30] Foreign Application Priority Data

Feb. 24, 1983 [DE] Fed. Rep. of Germany ..... 3306355

[51] Int. Cl.[4] ..... F01L 1/34

[52] U.S. Cl. ..... 123/90.17; 123/308; 123/315; 123/432

[58] Field of Search ..... 123/308, 315, 432, 90.16, 123/90.17, 90.18

[56] References Cited

U.S. PATENT DOCUMENTS 4,353,334 10/1982 Neitz ..... 123/90.16
4,404,937 9/1983 Leitermann ..... 123/90.16
4,429,853 2/1984 Chaffiote et al. ..... 123/90.16
4,442,806 4/1984 Matsuura et al. ..... 123/90.16
4,448,156 5/1984 Henault ..... 123/90.17
4,480,617 11/1984 Nakano et al. ..... 123/90.16

*Primary Examiner*—Ira S. Lazarus
*Attorney, Agent, or Firm*—Clifford L. Sadler; Robert E. McCollum

[57] ABSTRACT

An internal combustion engine comprising four valves for each cylinder consisting of a first pair of continuously operable intake and exhaust valves and a second pair of additional, optionally disconnectible intake and exhaust valves, the valve lift curve of the first pair being intended for torque in the partial load range and the second pair for power in the full load range, the engine including two overhead camshafts for actuating the four valves per cylinder, with the valves arranged so that in each case the disconnectible valves of two adjacent cylinders are adjacent to one another and may be actuated by cams on a sleeveshaft which is freely rotatable on the camshaft but may be coupled rotationally rigidly at the correct angle to the camshaft by way of an axially slidable shift collar.

3 Claims, 8 Drawing Figures

ENGINE WITH LOAD DEPENDENT VARIABLY OPERABLE INTAKE AND EXHAUST VALVING

The invention relates to the construction of an internal combustion engine with intake and exhaust valves in each cylinder capable of being rendered inoperable, as a function of load requirements, to conserve fuel and increase engine operating efficiency. More particularly, it relates to an engine having four valves per cylinder, with a first pair of intake and exhaust valves being continuously operable, and a second pair that can be rendered inoperable at will, the valve lift curves of the first pair being designed for torque in the part load engine operating range and the second pair for power in the full load range.

An internal combustion engine of this general type is known from German Laid-Open Specification DE OS No. 28 38 681, wherein two intake valves are provided per cylinder, one part load and one full load intake valve; however, only a single exhaust valve is provided. The part load intake valve is continuously in operation and the full load intake valve can be rendered operable or inoperable. There is no indication, however, of the nature of the coupling device required for selectively rendering the full load intake valve operable or inoperable.

A further internal combustion engine of this type is known from DE OS No. 29 01 186, in which each cylinder includes one intake and one exhaust valve and at least one additional load dependent valve that is operable or inoperable as a function of the load changes, which valve should be variable in its phase relationship with respect to the continuously operating valve. However, there is no indication of the structural measures required to change the phase relationship.

An internal combustion engine of this general type is also known from DE OS No. 29 49 529, in which a partial load intake valve and a full load intake valve and one exhaust valve are associated with each cylinder. Both intake valves are actuated simultaneously by separate camshafts, the camshaft actuating the full load intake valve being variable in its phase relationship with respect to the camshaft actuating the part load intake valve. The full load intake valve, however, in this case is not rendered operable or inoperable at will.

The prior art referred to above essentially deal only theoretically with the possibilities described for achieving variable load dependent valve timing, and they offer no solutions or means for achieving the variable valve timing.

An internal combustion engine with a plurality of cylinders is known from DE OS No. 30 42 018, in which a device is provided for rendering inoperable certain valves of certain cylinders. The said devices comprise a cam sleeve 40 that is axially displaceable on the camshaft and nonrotationally rigidly engaged at the correct phase angle with the cams corresponding to the valves to be rendered operable or inoperable. With this device, however, it is only possible to control the valves in the first and last cylinder of the engine; e.g., in a five cylinder engine, only cylinders 1 and 5, in a four cylinder engine, only cylinders 1 and 4, and in a six cylinder engine, only cylinders 1 and 6.

In the case of German Gebrauchsmuster G No. 80 13 233.8, all of the valves of one or more cylinders are rendered inoperable in each case, in order to run an internal combustion having six cylinders, for example, with only four cylinders in the part load range. Although a reduction in the fuel consumption may be achieved in this way, despite the expensive disconnecting device, a loss of comfort in the running of the internal combustion engine results because of the irregular ignition sequence.

The present invention seeks to provide a four valve per cylinder internal combustion engine with variable load dependent valve timing in which one pair of valves is continuously driven; i.e., connected at all times to the camshaft, while the second pair of valves in each cylinder may be selectively disconnected from the camshaft; i.e., rendered inoperable, by a coupling device that can be constructed with a minimum of expense and which ensures a trouble-free coupling process during the operating speeds at which the coupling must take place.

The present invention provides an internal combustion engine with variable, load dependent, valve timing comprising first and second pairs of engine driven intake and exhaust valves for each cylinder, one of the pairs being optionally disconnectible from the camshafts, the valve-lift curves of the first or continuously driven pair being designed for torque in the part load range, the second pair being designed for power in the full load range; two continuously driven overhead camshafts being provided for actuating the four valves of each cylinder, the cylinders being paired and the valves arranged so that for each pair of cylinders the valves to be rendered inoperable lie adjacent one another and are actuated by a sleeveshaft which has fixed thereon the cams for the respective disconnectable valves and is freely rotatably mounted on the respective camshaft, a coupling device being provided for selectively coupling the cam carrying sleeveshaft for rotation with the camshaft.

The preferred embodiment of the invention is a four cylinder engine with a firing sequence of 1-3-4-2. In such an embodiment, only two cam carrying sleeveshafts are required to permit the disengageable valves of all four cylinders to be coupled to or disengaged from each camshaft.

In the preferred embodiment of the invention, the sleeveshaft on which are mounted the cams for actuating the valves to be rendered operable or inoperable can be coupled for rotation with the camshaft by the energization of an electromagnet, which, acting through a shifting fork or yoke, axially drives a shift clutch means in the form of a collar against the action of a return spring, the collar being splined to the freely rotatable sleeveshaft. In this way, a reliable coupling action is ensured during the operating speeds at which the coupling must take place.

Conveniently, the shift collar is provided on one of its end faces with an axially projecting tooth which cooperates with a notch formed on an opposed surface continuously rotatable with the camshaft.

In such a construction, the electromagnet needs to apply only enough force to displace the fork and the shift collar, which together have relatively little mass.

Advantageously, the cams for actuating the first or continuously driven pair of valves are formed on further sleeveshafts that are fitted over the camshaft and rigidly coupled for rotation with it, the notches engageable by the projecting teeth of the shift collars being formed on end faces of respective ones of the further sleeveshafts.

Preferably, each tooth has a leading edge extending in a direction perpendicular to the direction of rotation of the camshaft and a trailing edge inclined at an angle to the perpendicular to the direction of rotation. By virtue of this construction, a wedge-shaped rotationally rigid connection without play is produced. The angle of inclination of the trailing edge should be sufficiently small, having regard to the coefficient of friction, to prevent the coupling tooth from becoming disengaged under the reaction force.

To prolong the period available for completing the coupling operation, it is advantageous for the notch to be preceded by a ramp.

Other objects, features and advantages of the invention will become apparent upon reference to the succeeding detailed description thereof, and to the drawings illustrating a preferred embodiment thereof; wherein, FIG. 1 is a vertical cross-sectional view through a cylinder head of an internal combustion engine embodying the invention in the direction of arrow I—I in FIG. 2 and along the valve axes of a pair of valves of a cylinder to be disabled;

Figure 1:
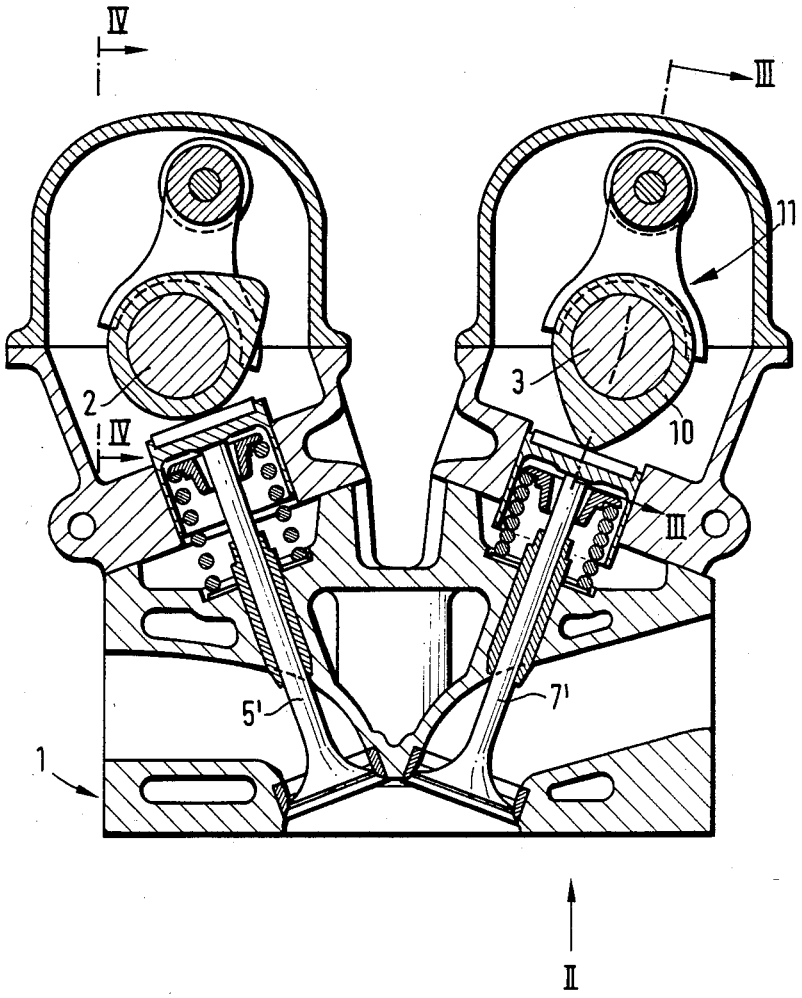

As seen in FIG. 1, an internal combustion engine according to the invention comprises a cylinder head 1, in which two overhead camshafts 2 and 3 are arranged, supported in a known manner. In this case, one camshaft 2 is provided for actuating the exhaust valves, such as the part load and full load exhaust valves 4' and 5' (FIG. 2), for example, disposed to one side in the cylinder head. The other camshaft 3 is provided for actuating the intake valves, such as the part load and full load intake valves 6' and 7', for example, disposed on the opposite side of the cylinder head.

In order to make clear the special arrangement of the continuously actuated part load intake and exhaust valves 6 and 4, respectively, as compared with the optionally disconnectible full load intake and exhaust valves 7 and 5, the combustion chambers associated with the cylinders 1, 2, 3 and 4 in the cylinder head have been provided on the corresponding valve parts with the same reference numerals, to which has been added a prime corresponding to the number of the respective cylinder.

Figure 2:
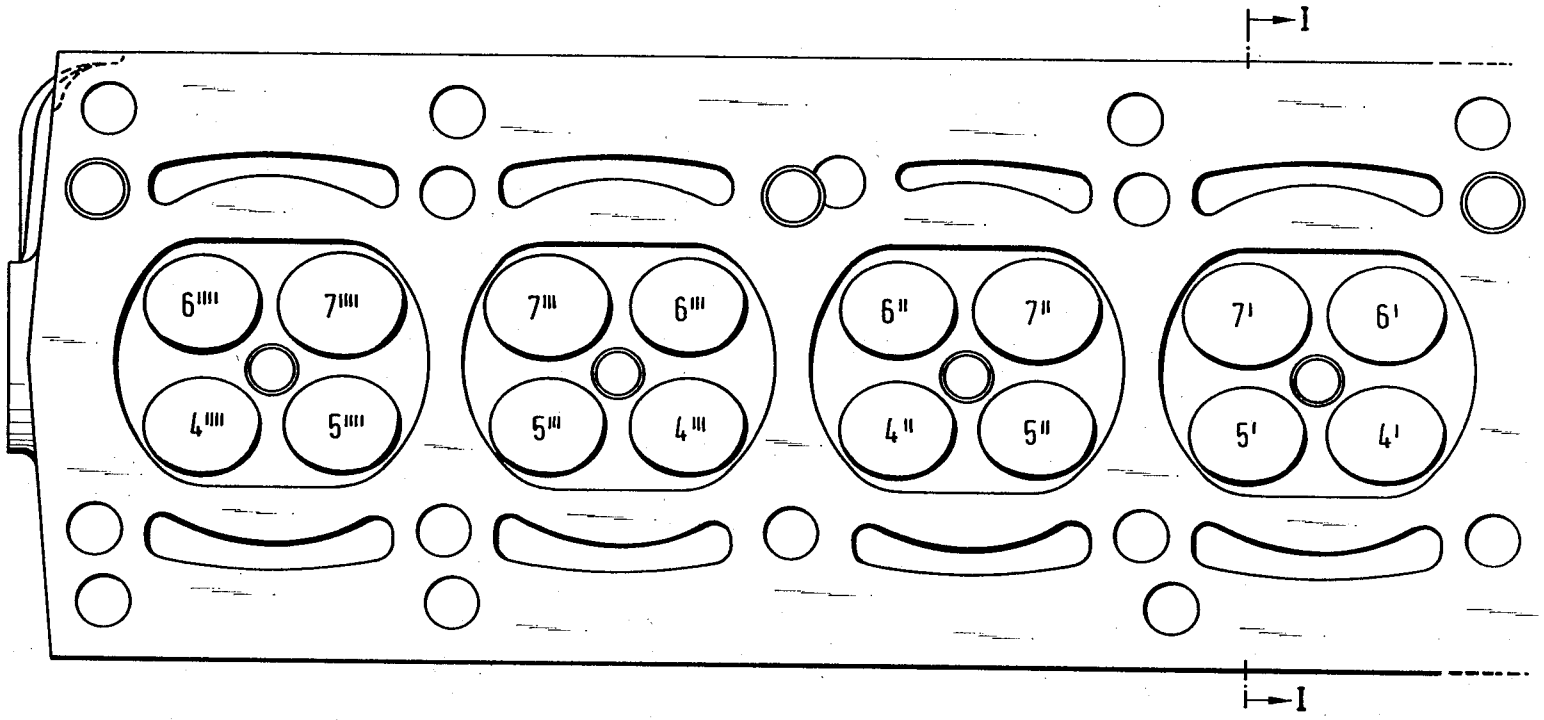
FIG. 2 is a bottom view of the cylinder head looking up in the direction of arrow II—II in FIG. 1.

FIG. 2 clearly indicates that in adjacent cylinders 1 and 2 (from right to left as seen in FIG. 2), the disconnectible full load intake valves 7' and 7'' and exhaust valves 5' and 5'' are disposed adjacent to one another. The same arrangement applies to adjacent cylinders 3 and 4, in which the disconnectible full load intake valves 7''' and 7'''' and exhaust valves 5''' and 5'''' are disposed adjacent one another.

It is possible, by virtue of this arrangement, to control the connection or disconnection of the valves of two adjacent cylinders by means of a single coupling device in each case.

For an internal combustion engine with the valve arrangement according to the invention, an ignition sequence of 1-3-4-2 is preferable since in this connection the intake cams of the first and second or the third and fourth cylinders, respectively, are in direct succession, so that an angle of at least 90° is available on the camshaft for the coupling time for connecting and disconnecting the additional full load valves.

Figure 3:
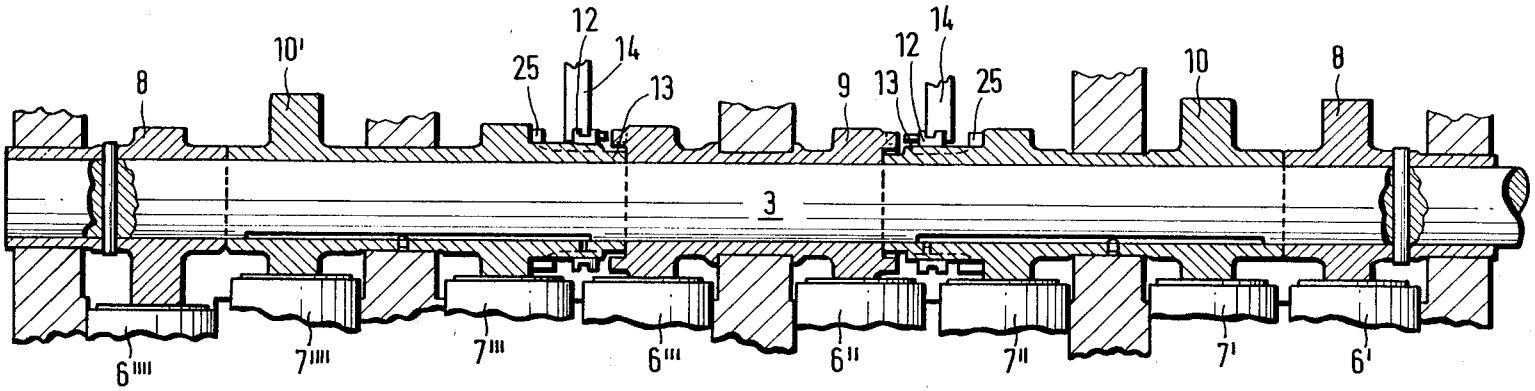
FIGS. 3 and 4 are partial cross-sectional views taken on planes indicated by and viewed in the direction of the arrows III—III and IV—IV, respectively, in FIG. 1.
Figure 4:
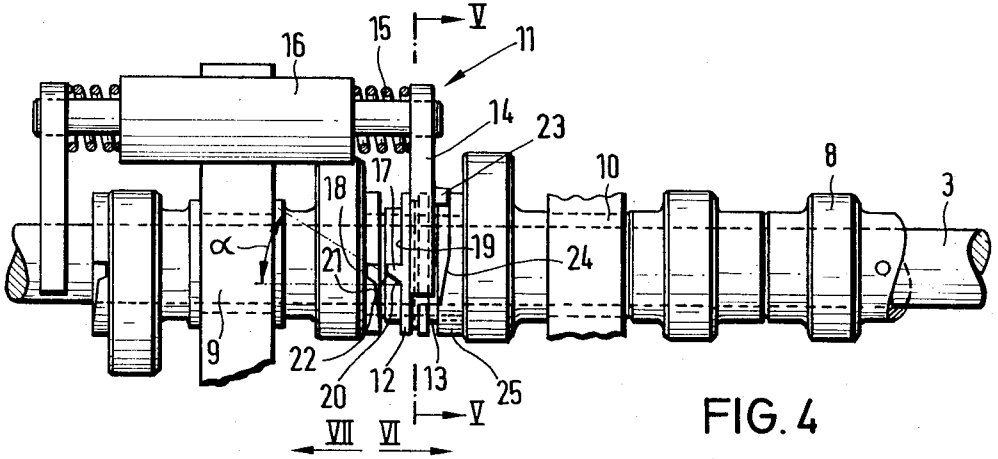
Figure 5:
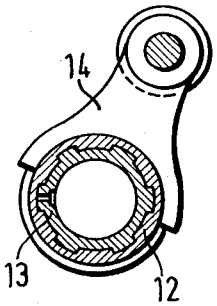
FIG. 5 is a sectional view taken on a plane indicated by and viewed in the direction of arrows V—V in FIG. 4.

As is evident from FIGS. 3 and 4 in particular, the cams for actuating a number of valves, the intake valves and the exhaust valves, respectively, are arranged on the camshaft 3, for example, in the form of two outer cam carrying sleeveshafts 8 fixed for rotation with the camshaft 3, a central cam carrying sleeveshaft 9 also fixed for rotation with the camshaft 3, and two lateral cam carrying sleeveshafts 10 that are freely rotatable on the camshaft 3.

As indicated in FIG. 3 in particular, the connectible and disconnectible full load intake valves 7' and 7'' of two adjacent cylinders 1 and 2 are actuated by way of a common cam carrying sleeveshaft 10, and in a similar manner the two connectible and disconnectible full load intake valves 7''' and 7'''' of the adjacent cylinders 3 and 4 are actuated by a common cam sleeveshaft 10'.

The structural arrangement of the coupling device for the sleeveshafts 10 and 10', respectively, which are freely rotatable on the camshaft 3, is explained in connection with FIGS. 3 and 4.

The coupling device 11 comprises a clutch means in the form of a shift collar 12, which is fixed for rotation with but axially displaceable on an extension 13 of the freely rotatable sleeveshaft 10, and a shifting fork or yoke 14, which engages in a groove of the shift collar 12 and which may be actuated against the force of a return spring 15 by an electromagnet 16.

The shift collar 12 is held on extension 13 of the sleeveshaft 10 by way of splines, one spline being made narrower in order to ensure that the shift collar 12 is mounted in the correct phase. On its end face toward the sleeveshaft 9 fixed to camshaft 3, the shift collar 12 is provided with an axially projecting tooth 17 (FIG. 4) which cooperates with a notch 18 formed in the opposite end face of the sleeveshaft 9 as soon as the shift collar 12 is moved axially against the force of spring 15 by way of the electromagnet 16 and the fork 14. In this case, in order to produce a connection without play between the tooth 17 and the notch 18, the tooth 17 has a leading edge 19 that is perpendicular to the direction of rotation and a trailing edge 20 inclined at an angle to the perpendicular. The angle must be kept smaller than the coefficient of friction between the tooth 17 and the notch 18, in order to prevent the shift collar 12 from being inadvertently disengaged.

Since the connection/disconnection of the full load intake and exhaust valves during the operation of the engine must take place during the transition from the part load range to the full load range, there is only a very short period of time available for the shifting procedure at the rotational speeds occurring in this case.

In order to prolong this period slightly, the coupling notch 18 is preceded by a ramp 21 against which the tooth 17 bears by way of a sliding edge 22 of the same inclination, at the beginning of a meshing movement. In this way a more reliable shifting procedure is obtained while at the same time preventing increased wear at the edges.

It can occur that sleeveshaft 10, which is freely rotatable on the camshaft 3, is already rotating if the sliding edge 22 is still bearing against ramp 21 during a meashing movement of the shift collar 12. In this case, the fork 14 is provided with an axial tooth 23 (FIG. 4) which cooperates with a cam surface or ramp 24 on a control ring 25 to produce an increased force in the direction of meshing of the tooth 17 into the notch 18. In this way a meshing movement initiated by the electromagnet 16 and the fork 14 is partially positively completed by an immediate rotation of sleeveshaft 10, and this ensures that the shifting procedure will be reliably completed within the available camshaft angle range of 90°.

Figure 6:
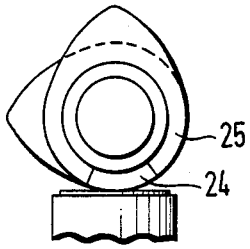
FIG. 6 is a view of the control ring in the direction of arrow VI in FIG. 4.
Figure 7:
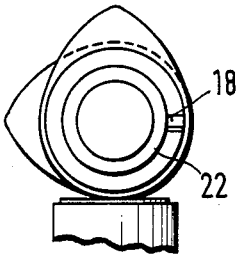
FIG. 7 is view of the end face of the rotationally rigid cam sleeve for the cams in the direction of arrow VII in FIG. 4.

FIGS. 6 and 7 are views to the right and left from the plane of the shift collar 12. FIG. 6 shows the ramp 24 on the control ring 25 on the one hand, and FIG. 7 shows the position of the notch 18 and the ramp 22 on the end face of sleeveshaft 9 fixedly mounted on camshaft 3 on the other hand. The axial tooth 23 in combination with the ramp 24 on the control ring 25 also ensures that the freely rotatable sleeveshaft 10 is in each case only disconnected when the valves controlled by sleeveshaft 10 are in their closed position.

Figure 8:
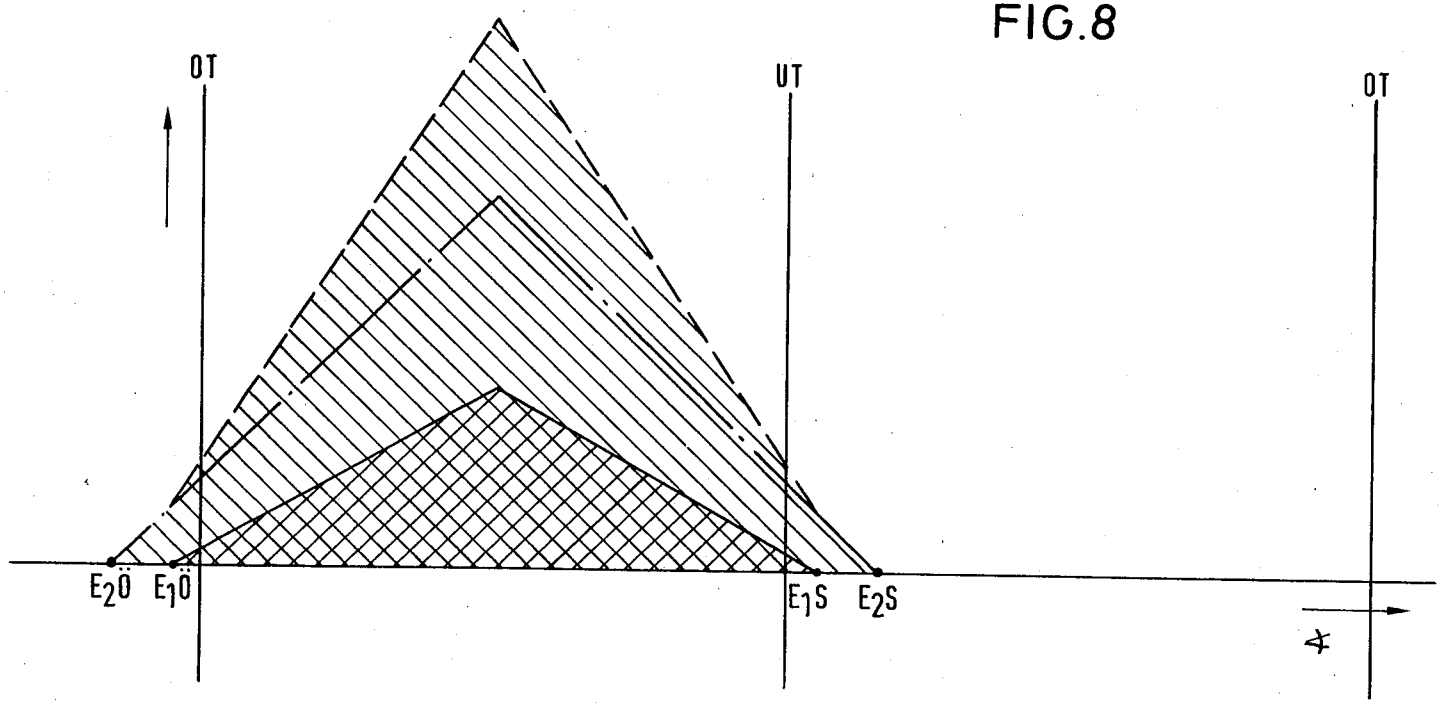
FIG. 8 is a diagram of the various timing cross-sections of the two different intake valves.

FIG. 8 illustrates the variation with time of the openings of the load dependent valves, achieved with an internal combustion engine according to the invention. Over the crankshaft angle, the opening cross-section of the continuously actuated part load exhaust valves is indicated in solid lines and cross-hatched for an intake valve.

The opening cross-section for the case in which only the full load intake valve is taken into consideration is indicated in dash-dot lines.

In the full load range, however, activating the full load intake valve in addition to the continuously actuated part intake valve results in a combined opening cross-section which is emphasized by broken lines and single hatching.

In this case the opening cross-sections are shown to be symmetrical, but it is possible, of course, for the cross-sections from the part load to the full load valves to be both asymmetrical and out of phase. The same applies to the overlapping range when taking into consideration the opening cross-sections of the intake and exhaust valves.

By arranging the stroke, valve diameter, valvelift curve and valve overlap between the part load and the full load intake valve differently, it is possible to optimize the torque of the internal combustion engine in such a way that the latter has a relatively high torque in the entire rotational speed range. In this connection, the valve overlap in the lower rotational speed range should be slight in order to avoid circulation losses. Thus, the opening cross-section for the part load intake valve would have a smaller valve overlap. In addition, in the case of a separate induction port guidance, throttling losses are kept low as a result of the small diameter of the part load intake valve. Furthermore, the part load intake valve will have a smaller stroke and a shorter valve-lift curve than the full load intake valve. When connecting the full load intake valve, not only is the opening cross-section of the intake port increased, but because of the greater valve overlap and the greater stroke and the greater valve-lift curve of the full load intake valve, substantially better breathing is also achieved at higher rotational speeds.

In the part load range a reduction in the friction losses in the internal combustion engine is obtained by disabling the full load load dependent valves, the result of which is a further improvement in the specific fuel consumption.

While the invention has been shown and described in its preferred embodiment, it will be clear to those skilled in the arts to which it pertains that many changes and modifications may be made thereto without departing from the scope of the invention.

I claim:

1. An internal combustion engine with variable, load dependent valve timing first and seciond pairs of intake and exhaust valves, respectively, in each cylinder, a pair of engine driven continuously rotating intake and exhaust valve camshafts with cams thereon engageable at all times, respectively, with the intake and exhaust valves of each cylinder, the cams engageable with the second pair of intake and exhaust valves for each cylinder for actuating the same being mounted for free rotation on their respective camshafts to render the drive of each pair by their camshafts inoperative at times, and coupling means operable to engage the freely rotatable cams with the camshaft for rotation, to thereby render operative the drive of the second pair of intake and exhaust valves of each cylinder concurrent with the actuation of the first pair of valves for each cylinder.

2. An internal combustion engine with variable, load dependent valve timing having first and second pairs of intake and exhaust valves, respectively, in each cylinder, a pair of engine driven continuously rotating intake and exhaust valve camshafts with cams thereon engageable at all times, respectively, with the intake and exhaust valves of each cylinder, the cams engageable with the second air of intake and exhaust valves for each cylinder for actuating the same being mounted for free rotation on their respective camshafts to render the drive of each pair by their camshafts inoperative at times, and coupling means operable to engage the freely rotatable cams with the camshaft for rotation, to thereby render operative the drive of the second pair of intake and exhaust valves of each cylinder concurrent with the actuation of the first pair of valves for each cylinder, the engine cylinders being arranged in pairs with like valves of adjacent cylinders being arranged next to one another for actuation by a common camshaft.

3. An internal combustion engine with variable, load dependent valve timing having first and second pairs of intake and exhaust valves, respectively, in each cylinder, a pair of engine driven continuously rotating intake and exhaust valve camshafts with cams thereon engageable at all times, respectively, with the intake and exhaust valves of each cylinder, the cams engageable with the second pair of intake and exhaust valves for each cylinder for actuating the same being mounted for free rotation on their respective camshafts to render the drive of each pair by their camshafts inoperative at times, and coupling means operable to engage the freely rotatable cams with the camshaft for rotation, to thereby render operative the drive of the second pair of intake and exhaust valves of each cylinder concurrent with the actuation of the first pair of valves for each cylinder, the means mounting the cams for a free rotation comprising a sleeveshaft, and an axially movable clutch means for coupling the sleeveshaft to the camshaft, the clutch means including spring means biasing the clutch means out of engagement with the camshaft, and electromagnet means operable when energized to engage the sleeveshaft to the camshaft, the clutch means including a shift collar having a splined connection to the sleeve-shaft for rotation therewith as well as an axial sliding movement relative thereto, shifting fork means engageable with the shifting collar and the electromagnet means for moving the collar axially, and tooth and notch type connecting means between the camshaft and collar for engagement upon energization of the electromagnet means to couple the magnet and sleeveshaft together, and a prong projecting axially from the fork means engageable with a circumferentially extending cam surface on a control ring secured to the sleeveshaft to forceably move the shift collar tooth axially toward a meshing engagement with the notch upon rotation of the collar relative to the shift fork means.

* * * * *